United States Patent [19]

Curtis

[11] Patent Number: 4,693,764

[45] Date of Patent: Sep. 15, 1987

[54] CONTROL OF PROCESSIBILITY BY PARTICLE SIZE IN HIGH ENERGY SOLID PROPELLANTS

[75] Inventor: Donald D. Curtis, San Jose, Calif.

[73] Assignee: The United States of America as represented by the Secretary of the Navy, Washington, D.C.

[21] Appl. No.: 909,362

[22] Filed: Sep. 18, 1986

[51] Int. Cl.[4] ..... C06B 45/10

[52] U.S. Cl. ..... 149/19.4; 149/19.9; 149/21; 149/92; 149/111

[58] Field of Search ..... 149/19.4, 19.9, 21, 149/92, 111

[56] References Cited

U.S. PATENT DOCUMENTS

| | | | |
|---|---|---|---|
| 3,022,149 | 2/1962 | Cramer | 149/19 |
| 3,255,281 | 6/1966 | Alexander | 264/3 |
| 3,480,490 | 11/1969 | Finger et al. | 149/92 |
| 3,745,076 | 7/1973 | Sickman et al. | 149/19 |
| 4,154,633 | 5/1979 | Pierce | 149/19.4 |
| 4,158,583 | 6/1979 | Frosch | 149/19.4 |
| 4,180,424 | 12/1979 | Reed | 149/19.4 |
| 4,632,715 | 12/1986 | Curtis | 149/19.5 |

FOREIGN PATENT DOCUMENTS 2809279 9/1979 Fed. Rep. of Germany .

*Primary Examiner*—Stephen J. Lechert, Jr.
*Attorney, Agent, or Firm*—C. D. B. Curry; S. G. Precivale

[57] ABSTRACT

A solid propellant which utilizes a high solids loading of blended HMX (84.8%) by combining unground and ground HMX particles to achieve desired processing control.

1 Claim, No Drawings

CONTROL OF PROCESSIBILITY BY PARTICLE SIZE IN HIGH ENERGY SOLID PROPELLANTS

BACKGROUND OF THE INVENTION

1. Field of the Invention

This invention relates to high energy solid propellants. More particularly, this invention relates to utilizing fluid energy milled ground HMX monopropellant (oxidizer) in propellants. Still more particularly, but without limitation thereto, this invention combines ground and unground HMX particles in propellants to achieve the desired processing control.

2. Description of the Prior Art

Various techniques have been attempted in the prior art to improve solid propellant processibility. more specifically, interest has been focused on the HMX content. However, despite the development of the art, there has remained a continuing need for improved manufacturing characteristics for solid propellants. The properties studied have included the particular HMX blending, grinding size, distribution and percentage of ground/unground states.

SUMMARY OF THE INVENTION

An object of the present invention is to provide a high energy solid propellant having improved viscosity control and manufacturability.

A further object of this invention is to control propellant batch-to-batch variations induced by lot related HMX particle size variations by achieving reproducible particle size distribution.

These and other objects have been demonstrated by the present invention wherein a solid propellant utilizes a combination of ground and unground HMX particles.

DESCRIPTION OF THE PREFERRED EMBODIMENT

The oxidizer used in high energy solid propellants is normally comprised of a coarse and a fine HMX fraction. For example, a mixture of Class 1 (coarse) and Class 5 (fine) HMX as defined by the Military Specification, MIL-H-45444, is common. Their relative proportions and average mean diameter vary broadly. Typically, the HMX fine fraction has an average mean diameter of 7 microns. It has been found that grinding coarse HMX to some fine particle size using the fluid energy mill, allows for more reproducible propellant processing characteristics. For that reason, this invention uses a fine or ground fraction having a nominal average mean diameter of 8–16 microns, with a coarse unground fraction having an average mean diameter of 150 microns. Fluid energy milling is an especially suitable method of grinding the HMX particles since HMX is explosive and generates static electricity during the grinding operation.

In order to optimize HMX particle size distribution, it is necessary to define the particle sizes of HMX that can be effectively ground on the fluid energy mill (FEM). A fluid energy mill operates to continuously grind a solid by means of pressurized elastic fluids such as compressed air, which enters the mill through special nozzles. Both the pressure at which the elastic fluid is introduced to the mill and the diameters of the nozzles affect the particle size of the material to be ground up. For production purposes, a 12" diameter FEM is used.

The mill feed rate parameter also influences the ground HMX particle size. At a feed rate of 750 lbs/hr, a particle size range of 6–19 microns is obtained. Similarly, a particle size of 5–16.5 microns is demonstrated at a 350 lbs/hr feed rate. In both instances, the larger particle sizes are the extremes of the range and are therefore hard to reproduce in that small changes in mill pressure results in significant variances in the average particle size.

Based upon the data generated, it appears that average particle sizes in the range of 8–16 microns are quite reproducible. It is advisable to avoid very low mill pressures as the particle size distributions are irregular. Since these particle size distributions are irregular, these particle sizes would be difficult to reproduce in a production process.

The key to achieving good propellant flow properties and excellent batch-to-batch reproducibility of propellant properties is to reproducibly achieve optimum HMX particle packing.

Four average particle sizes of ground HMX (19, 15, 9 and 6 microns) were studied. These were all obtained by fluid energy milling of coarse unground HMX having an average mean diameter of 150 microns, the overall range being 45–300 microns. The distribution of the unground HMX is shown in Table 1. One unique feature of this invention is that both the ground and unground HMX particles are obtained from the same source: the HMX is used as is, for the unground fraction and is fluid energy milled for the ground fraction.

TABLE 1

| U.S. Standard Sieve No. | 50 | 100 | 250 | 325 |
|---|---|---|---|---|
| Percent through | 90 ± 6 | 45 ± 15 | 20 ± 10 | 8 ± 4 |
| Max. particle size (μ) | 300 | 150 | 75 | 45 |

Unground/ground (coarse/fine) ratios ranging from 80:20 to 50:50 were studied to find the ratio which yielded optimum flow characteristics and therefore better particle packing. The results are shown in Table 2.

TABLE 2

| Fine HMX Particle size, microns | Coarse/Fine Ratio for Optimum Flow |
|---|---|
| 19 | 50/50 |
| 15 | 60/40 to 70/30 |
| 9 | 70/30 |
| 6 | 80/20 |

For the particle size range of 8–16 microns, the ratio of coarse to fine for optimum flow is from 60:40 to 70:30.

The effect of HMX particle distribution on mix casting rates correlates to both unground HMX particle size and to fluid energy milled (ground) HMX particle size. In testing four particle sizes (22, 16, 8 and 4 microns) it was noted that as ground HMX distribution shifts from 4 microns to 22 microns, casting rates pass through a maxima and then drop off again. The maximum cast rate for unground HMX is higher for the coarser grade (>150 microns) than for the finer grade (<150 microns). In either case, the maximum rate is achieved using ground HMX with particle sizes ranging from 8–16 microns. This is the key consideration since the unground HMX distribution has significantly less effect on propellant flow properties than does ground HMX size distribution. Although high propellant flow rates are desirable for some reasons, there are some distinct disadvantages. Most important of these is the fact that there is a higher risk of casting voids where propellant flow rates are very high. This factor must be taken into consideration when selecting the fluid energy milled HMX size.

Studies of the relationship between HMX particle distribution and stress, stain and modulus properties (tangent modulus, maximum rise and secant modulus, 2.5% strain) indicates that finer HMX in either unground or ground feedstocks, promotes higher propellant strain values and that secant modulus is directly proportional to the unground HMX size but inversely proportional to the FEM HMX.

Analysis of the effect of HMX particle distribution versus processibility reveals that propellant processing will be acceptable if unground HMX as defined by Table 1 and ground HMX having an average mean diameter of 8–16 microns is used to blend a composite mixture of HMX in the range of 60:40 to 70:30 coarse to fine within overall pre-determined limits. Table 3 provides the composite particle size distribution limits for blended HMX necessary to optimize processibility.

TABLE 3

| Percent greater than | 7 ± 7 | 18 ± 12 | 47 ± 10 | 57 ± 9 | 65 ± 7 | 68 ± 6 | 71 ± 7 | 77 ± 10 | 88 ± 6 | 95 ± 5 |
|---|---|---|---|---|---|---|---|---|---|---|
| Nom. particle size, μ | 300 | 200 | 100 | 70 | 40 | 30 | 20 | 10 | 4 | 2 |

In using ground HMX, all propellant properties must be studied to insure that the advantages associated with better processibility are not outweighed by serious disadvantages. Therefore, although processibility remains good using ground HMX as small as 4 microns, in order to maintain reproducible particle size and optimum casting rates, the preferred ground HMX particle size for this invention is 8–16 microns. Surprisingly, studies indicate that HMX particle size appears to have an insignificant effect upon the propellant burn rate and pressure exponent. Mixes using ground HMX tend to exhibit higher viscosities than is desired. This can best be dealt with by extending the mixing time after each addition of the curative. In this manner, the viscosity can be minimized.

To incorporate the concept of mixing unground and ground HMX, a suitable propellant composition by weight, is as follows: about 15.15% hydroxyl terminated polybutadiene polymer combined with isophorone diisocyanate curative, about 0.05% carbon black and about 84.8% HMX (unground/ground mix). As for the carbon black, commercially available carbon black sold under the tradename "Elftex 8" by Cabot Corporation (New Jersey) has proven to be especially suitable.

This invention has been described in detail with particular reference to certain preferred embodiments thereof, but it will be understood that variations and modifications can be effected within the spirit and scope of the invention.

What is claimed is:

1. A solid propellant comprised on a weight basis of about 15.15% hydroxyl terminated polybutadiene polymer combined with isophorone diisocyanate; about 0.05% carbon black; and about 84.8% of a mixture of unground HMX having an average means diameter of about 150 microns and ground HMX, having an average mean diameter of about 8–16 microns, wherein the ratio of said ground to unground HMX is from 60:40 to 70:30 by weight and wherein the composite HMX particle size distribution is within the following limits:

| Percent greater than | Nom. particle size, μ |
|---|---|
| 7 ± 7 | 300 |
| 18 ± 12 | 200 |
| 47 ± 10 | 100 |
| 57 ± 9 | 70 |
| 65 ± 7 | 40 |
| 68 ± 6 | 30 |
| 71 ± 7 | 20 |
| 77 ± 10 | 10 |
| 88 ± 6 | 4 |
| 95 ± 5 | 2 |

* * * * *